United States Patent [19]

Gemmell

[11] Patent Number: 4,765,094

[45] Date of Patent: Aug. 23, 1988

[54] DRAUGHT EXCLUDER

[76] Inventor: Robert J. Gemmell, 3 Fort Street, Motherwell, ML1 1QR, Scotland

[21] Appl. No.: 9,978

[22] Filed: Feb. 2, 1987

[51] Int. Cl.[4] ..... E06B 7/16; E06B 9/52

[52] U.S. Cl. ..... 49/475; 49/58; 49/488; 49/493

[58] Field of Search ..... 49/475, 493, 58, 60, 49/485, 488, 500

[56] References Cited

U.S. PATENT DOCUMENTS

| | | | |
|---|---|---|---|
| 712,240 | 10/1902 | Barnes et al. | 49/488 |
| 2,786,711 | 3/1957 | Culver | 49/500 X |
| 4,320,598 | 3/1982 | Rodak et al. | 49/488 X |

FOREIGN PATENT DOCUMENTS

| | | |
|---|---|---|
| 134433 | 11/1919 | United Kingdom . |
| 381798 | 10/1932 | United Kingdom . |
| 539755 | 9/1941 | United Kingdom . |
| 568489 | 4/1945 | United Kingdom . |
| 875480 | 8/1961 | United Kingdom . |
| 1079667 | 8/1967 | United Kingdom . |
| 1267733 | 3/1972 | United Kingdom . |
| 2109447 | 6/1983 | United Kingdom . |
| 2170541 | 8/1986 | United Kingdom . |

*Primary Examiner*—Philip C. Kannan

*Attorney, Agent, or Firm*—Dickstein, Shapiro & Morin

[57] ABSTRACT

A draught excluder 10 is provided for a door 28. The draught excluder comprises an elongated member 12 having an outer surface 14 which is at least partially flexible, and attachment means 16, 20 connected to the elongated member for releasably attaching the elongated member to the bottom of the door. The attachment means comprises a pair of resiliently extensible cords 20 and a pair of rollers 16, and the elongated member comprises a hollow core 18 located within a sleeve 15, both of which are permeable to gas, the core containing material for releasing a volatile pesticide.

38 Claims, 1 Drawing Sheet

DRAUGHT EXCLUDER

BACKGROUND

The invention relates to a draught excluder.

Conventional draught excluders known to the Applicant are usually in the form of an elongated, substantially cylindrical envelope which is filled with a suitable material, e.g., sand, wood shavings or the like. When the door is in its closed position, the device is placed on the floor in abutting relationship with the bottom of the door so as substantially to seal the gap between the floor and bottom of the door. However, this has the disadvantage that, when the door is open, the device is moved out of position and consequently has to be repositioned when the door is closed again.

SUMMARY

According to the invention there is provided a draught excluder for a door, the draught excluder comprising an elongated member having an outer surface which is at least partially flexible, provided by an elongated core located within an elongated sleeve of flexible material which provides the flexible outer surface of the elongated member, and attachment means connected to the elongated member for releasably attaching the elongated member to the bottom of a door to extend along the bottom of the door in contact with the bottom of the door and in contact with a floor under the door.

It is an advantage of the draught excluder according to the invention that the need to reposition it after opening and closing of a door is at least substantially reduced, if not avoided entirely, and that when the door is being opened or closed, the rollers will roll along the floor, thus avoiding or reducing damage to floor coverings such as carpets, or the like.

In use, when the door is closed, the draught excluder is intended to exclude, or at least resist, the passage of draughts, dust, insects, or the like, through a doorway closed by the door, past the door and through such gap as is present between the bottom of the door and a floor under the door. In this regard, the bottom of a door frame in which the door is located is regarded as part of the floor.

The elongated member may be resiliently flexible, in the sense that it tends to resume its original shape, if it is compressed, bent, or the like. The core may thus be resiliently flexible. In this embodiment, the core may be in the form of a hollow cylinder, the material of the core and sleeve being permeable to gas, and a volatile material being located in the interior of the cylinder. This volatile material may comprise a perfume, deodorant, disinfectant, pesticide, or the like. In a particular embodiment of the invention, the volatile material may be an insecticide.

The cylinder may be open at at least one end thereof, the associated end of the sleeve being open and being tucked into the open end of the cylinder, where it is held in position by a removable plug. Naturally, both ends of the cylinder and sleeve may be open, being provided with plugs, the plug feature permitting removal of the core from the sleeve, so that the sleeve may be washed, replaced, or the like, and so that a supply of volatile material in the interior of the cylinder may be renewed or replaced.

It is contemplated that the core may, in certain embodiments of the invention, be in the form of a hollow cylinder of cardboard, paper, or the like, and that the sleeve may be of resiliently flexible foam material, textile material, or the like. The plug or plugs are conveniently cup-shaped and of synthetic plastics material, having cylindrical bodies for insertion into the cylinder of the core, and preferably rounded or convex floors. Naturally, if desired, use may be made of a hollow cylindrical core and sleeve to form the elongated member, without any volatile material, in which case the core and sleeve need not be permeable to gas. Furthermore, if desired, a solid core may be employed, and this core need not be either resilient or flexible, or may merely be flexbile without being resilient.

In a particular embodiment in the invention, the attachment means may be provided by an attachment member connected to the elongated member by a resiliently extensible flexible cord. In this embodiment, the draught excluder will be attached in use in position to the bottom of a door by passing the flexible cord under the door through such gas as exists between the bottom of the door and a floor under the floor, so that the elongated member and attachment member are located on opposite sides of the bottom of the door, and held in position there by the flexible cord. Preferably, the cord is under tension, so that the resiliently extensible flexible cord mentioned above is preferred.

Although a single attachment member may be employed, the attachment means preferably comprises a plurality of said attachment members, attached to the elongated member as positions spaced in series along the elongated member, each by means of an associated resiliently flexible cord.

Each attachment member may be in the form of a roller, the associated cord having opposite ends thereof anchored to the elongated member, and the cord passing along a central passage through the roller. The Applicant has found that it is convenient to employ two such rollers, spaced from each other and located adjacent opposite ends of the elongated member. When the draught excluder comprises one or more rollers, they can roll along a floor which is under the door, when the door is opened or closed.

BRIEF DESCRIPTION OF THE DRAWINGS

The invention will now be described by way of example, with reference to the accompanying diagrammatic drawings, in which.

DETAILED DESCRIPTION OF THE PREFERRED EMBODIMENTS

Figure 1:
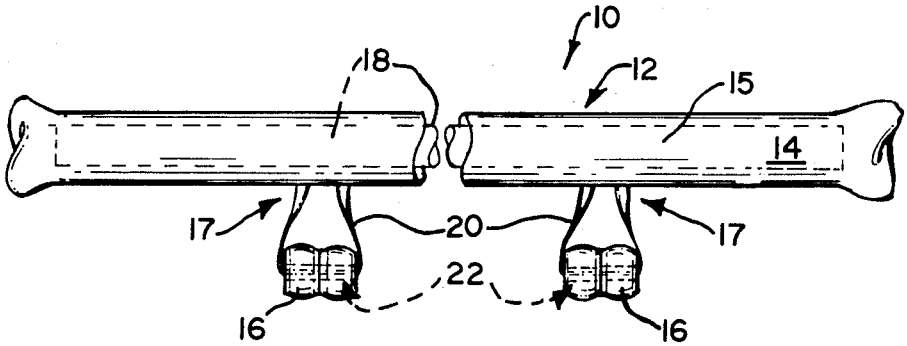
FIG. 1 is a fragmented front view of a draught excluder according to the invention.
Figure 2:
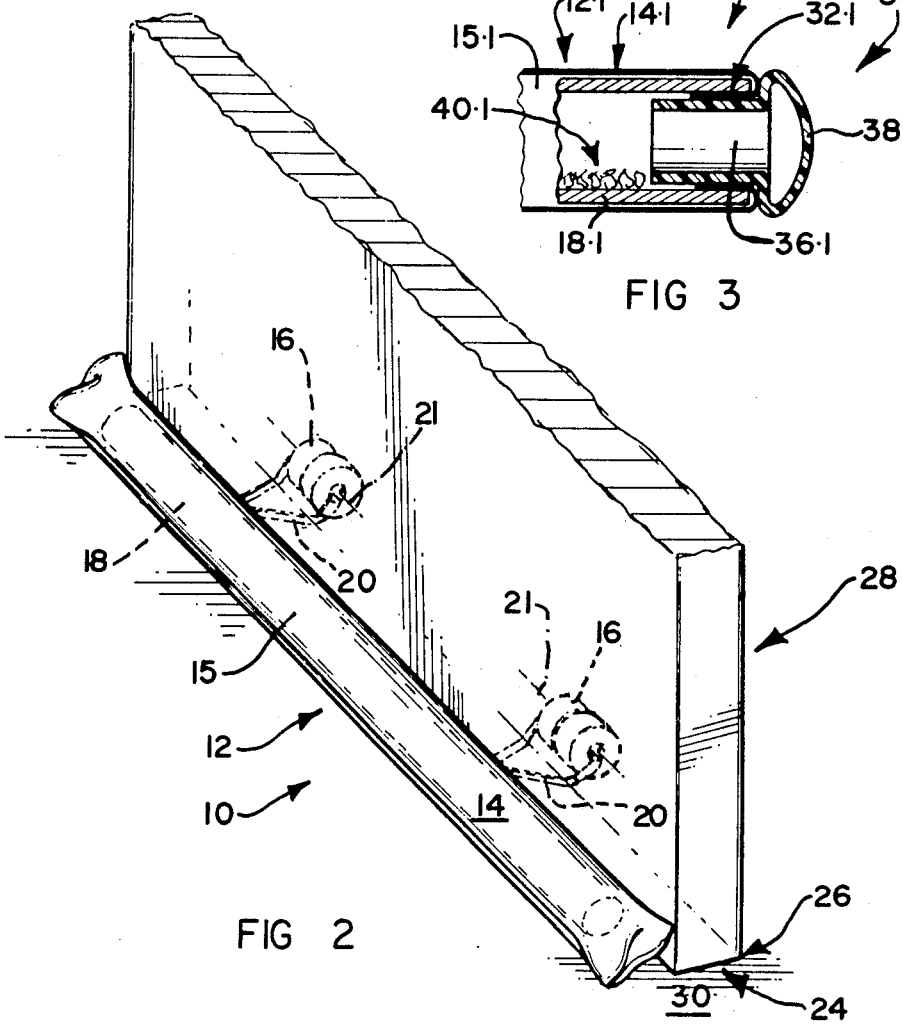
FIG. 2 is a partly cut-away three dimensional view of the draught excluder of FIG. 1, in its operative position, attached to the bottom of a door.

With reference first to FIGS. 1 and 2 of the drawings, generally, reference numeral 10 indicates a draught excluder for a door according to the invention.

The draught exluder 10 comprises an elongated member 12 having an outer surface 14 provided by an elongated sleeve 15 of flexible textile material, and two attachment members in the form of wooden rollers 16 anchored to the elongated member 12 at positioned 17 spaced along the length of elongated member 12.

The elongated member 12 has a hollow resiliently flexible core 18 in the form of a cylinder of cardboard.

The rollers 16 are secured to the elongate member 12 by means of resiliently extensible cords in the form of elastomeric cords 20 threaded through central passages 22 through the rollers 16, the passages 22 being formed centrally through the rollers 16 to provide the rotational axes 21 of the rollers 16. Opposite ends of the cords are anchored to the elongated member 12 at 17, and the cords pass alongs said passages 22.

Referring particularly to FIG. 2 of the drawings, the cords 20 pass in use through the gap 24 between the bottom 26 of a door 28 and a floor 30 under the door. The cords 20 are stretched under tension respectively between the rollers 16 and the elongated member 12, thus maintaining the elongated member 12 and the rollers 16 releasably and under bias in abutting relationship and in contact with opposite sides of the bottom 26 of the door 28, and in contact with the floor 30.

In use, the excluder 10 will remain in position extending along the bottom of the door, when the door is opened or closed, and when the door is closed it automatically assumes its functional position, closing the gap 24, to exclude draughts, dust, insects, etc., and to resist their passage through the doorway closed by the door.

Figure 3:
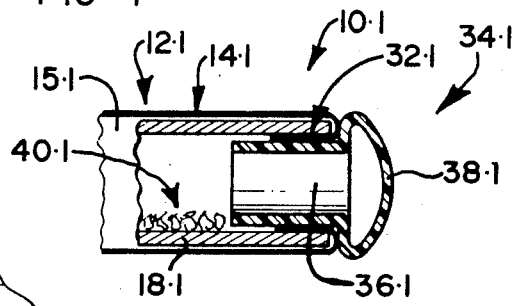
FIG. 3 is a detail in sectional side elevation of one end of another draught excluder according to the invention.

With reference now to FIG. 3, a variation of the invention is shown, in which corresponding numerals are used for corresponding parts. In FIG. 3, the part of the draught excluder shown is generally designated by reference numeral 10.1, the elongated member being designated by 12.1, the flexible surface by 14.1, the sleeve by 15.1, and the core by 18.1. The core 18.1 is of a material which is permeable to the passage of gas, being of woven, perforated, or the like construction. The core 18.1 and sleeve 15.1 are both open at opposite ends thereof, each end of the sleeve 15.1 being tucked into the associated end of the core 18.1, as shown at 32.1, being held in position there by means of a plug 34.1. The plug 34.1 is broadly cup-shaped, having a cylindrical body portion 36.1 which fits into the open end of the core 18.1 and holds the sleeve 15.1 in position at 32.1, and a rounded or convex floor or base 38.1, the plug 34.1 being in the form of synthetic plastics moulding.

In use, with reference to FIG. 3, it is contemplated that a volatile material, as shown by a solid material at 40.1 which releases a gas, may be inserted into the interior of the core 18.1, where it performs the function of releasing a gaseous perfume, deodorant, disinfectant, pesticide, or the like. It is contemplated in particular that in situations where insects are a problem, the volatile material may be an insecticide, so that the draught exluder 10 functions both physically and chemically to resist passage of insects through a doorway closed by the door 28, via the gap 24 between the bottom 26 of the door and the floor 30.

Furthermore, with the construction shown in FIG. 3, the sleeve 15.1 can be removed from the core 18.1, for example for the purpose of cleaning the sleeve 15.1 by washing, and an end of the core 18.1 can be opened by removal of the associated plug 34.1, to permit renewal or replacement of exhausted material 40.1.

What is new and desired to be secured by Letters Patent of the United States is

I claim:

1. A draught excluder for a door, the draught excluder comprising an elongated member having an outer surface which is at least partially flexible, the elongated member being formed of a material which is permeable to gas, and attachment means for attaching said elongated member to the door and including a plurality of roller means each of which is attached to said elongated member at spaced intervals therealong by a resiliently extensible flexible cord and the elongated member and the rollers are held against opposed sides of the door by the resiliently extensible flexible cord.

2. A draught excluder as in claim 1, wherein each roller includes a central passage therethrough, the cord passing along said passage and being anchored at its end to the elongated member.

3. A draught excluder as in claim 1 wherein the elongated member carries a volatile material adapted to escape through the gas permeable material of said member.

4. A draught excluder as in claim 3 wherein the elongated member includes an elongated core that carries the volatile material and that is located within an elongated sleeve of flexbile material.

5. A draught excluder as in claim 4 wherein the elongated core is a hollow cylinder.

6. A draught excluder as in claim 5 wherein at least one end of the cylinder is open, and the associated end of the sleeve is tucked into said open end and held in position by a removeable plug.

7. A draught excluder as in claim 6 wherein the volatile material is located within the hollow cylinder.

8. A draught excluder for inhibiting a draught from flowing under a door comprising:

blocking means for blocking the space under the door;

gas dispersing means for dispersing a gas in the vicinity of said blocking means; and attachment means for attaching said blocking means and said gas dispersing means to the door to move with said door upon opening and closing of said door.

9. A draught excluder as in claim 8 wherein said gas dispersing means disperses a pesticide.

10. A draught excluder as in claim 8 wherein said gas dispersing means disperses a perfume.

11. A draught excluder as in claim 8 wherein said blocking means includes an elongated member being formed of a material which is permeable to gas and said gas dispersing means is positioned within said elongated member.

12. A draught excluder as is claimed in claim 11 wherein said gas dispersing means includes volatile material that evolves a gas.

13. A draught excluder as in claim 12 wherein said elongated member includes a hollow cavity for carrying said volatile material.

14. A draught excluder for a door, the draught excluder comprising an elongated member having an outer surface which is at least partially flexible, and attachment means for attaching said elongated member to the door and including a plurality of roller means each of which is attached to said elongated member at spaced intervals therealong by a resiliently extensible flexible cord and the elongated member and the rollers are held against opposed sides of the door by the resiliently extensible flexible cord.

15. A draught excluder as in claim 14, wherein each roller includes a central passage therethrogh, the cord passing along said passing and being anchored at its ends to the elongated member.

16. A draught excluder as in claim 14 wherein the elongated member includes an elongated core that is located within an elongated sleeve of flexible material.

17. A draught excluder as in claim 16 wherein the elongated core is a hollow cylinder.

18. A draught excluder as in claim 17 wherein at least one end of the cylinder is open, and the associated end of the sleeve is tucked into said open end and held in position by a removable plug.

19. A draught excluder as in claim 17 wherein the hollow cylinder is perforated.

20. A draught excluder as in claim 14 wherein the elongated member is formed of a material which is permeable to gas.

21. A draught excluder as in claim 20 wherein the elongated member carries a volatile material adapted to escape through the gas permeable material of said member.

22. A draught excluder as in claim 21 wherein the elongated member includes an elongated core that carries the volatile material and that is located within an elongated sleeve of flexible material.

23. A draught excluder as in claim 22 wherein the elongated core is a hollow cylinder.

24. A draught excluder as in claim 23 wherein the volatile material is located within the hollow cylinder.

25. A draught excluder for inhibiting a draught from flowing under a door comprising:

blocking means for blocking the space under the door;

substance dispersing means for dispersing a substance in the vicinity of said blocking means; and attachment means for attaching said blocking means and said substance dispersing means to the door to move with said door upon opening and closing of said door.

26. A draught excluder as in claim 25 wherein said substance dispersing means disperses a pesticide.

27. A draught excluder as in claim 25 wherein said substance dispersing means disperses a perfume.

28. A draught excluder as in claim 25 wherein said blocking means includes an elongated member having an outer surface that is perforated to allow the passage of said substance there through and said substance dispersing means is positioned within said elongated member.

29. A draught excluder as in claim 28 wherein said substance is a gas and said substance dispersing means includes volatile material that evolves said gas.

30. A draught excluder as in claim 29 wherein said elongated member includes a hollow cavity for carrying said volatile material.

31. A draught excluder for a door, the draught excluder comprising:

an elongated member having an outer surface which is at least partially flexible;

the elongated member including an elongated core located within an elongated sleeve of flexible material which provides the flexible outer surface of the elongated member; and attachment means connected to the elongated member for releasably holding the elongated member against the bottom of the door to extend along the bottom of the door in contact with the bottom of the door and in contact with a floor under the door, said attachment means including a plurality of rollers spaced in series along the elongated member, each roller being attached to the elongated member by means of an associated resiliently extensible flexible cord which, in use, is extended so that the elongated member and the plurality of rollers are drawn against opposed sides of the door.

32. An excluder as in claim 31 wherein the elongated core is resiliently flexible.

33. An excluder as in claim 31 wherein the elongated member is permeable to gas and a volatile material which releases a gas is inserted in the interior of the core.

34. An excluder as in claim 33 wherein the volatile material is an insecticide.

35. An excluder as in claim 33 wherein the core is in perforated so as to be permeable to gas.

36. An excluder as in claim 31 wherein the core is in the form of a hollow cylinder.

37. An excluder as in claim 36 wherein the cylinder is open at at least one end thereof, the associated end of the sleeve being open and being tucked into the open end of the cylinder, where it is held in position by a removable plug.

38. An excluder as in claim 31 wherein the cord associated with each roller extends through a central passage through the roller and is anchored at its ends to the elongated member.

* * * * *